US006854279B1

(12) United States Patent
Digiovanni et al.

(10) Patent No.: US 6,854,279 B1
(45) Date of Patent: Feb. 15, 2005

(54) DYNAMIC DESICCATION COOLING SYSTEM FOR SHIPS

(75) Inventors: Anthony J. Digiovanni, Sewell, NJ (US); Denis J. Colahan, Morton, PA (US); Donald T. Knauss, Severna Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/457,701

(22) Filed: Jun. 9, 2003

(51) Int. Cl.[7] ..... F25D 17/06; F25D 23/00
(52) U.S. Cl. ..... 62/94; 62/271
(58) Field of Search ..... 62/93, 94, 271

(56) References Cited

U.S. PATENT DOCUMENTS 3,401,530 A * 9/1968 Meckler ..... 62/235.1
4,113,004 A * 9/1978 Rush et al. ..... 165/7
4,786,301 A 11/1988 Rhodes
5,170,633 A 12/1992 Kaplan
5,660,048 A 8/1997 Belding et al.
5,890,372 A 4/1999 Belding et al.
RE37,464 E 12/2001 Meckler

* cited by examiner

*Primary Examiner*—Chen Wen Jiang
(74) *Attorney, Agent, or Firm*—Steven W. Crabb

(57) ABSTRACT

The present invention describes methods and apparatus for controlling the humidity of air supplied to cooling coils on a gas turbine powered ship through a dynamic desiccation system. The system passes supply air through a desiccant wheel, which dries and concomitantly heats the supply air. This supply air stream is then passed through a rotatable thermal wheel, wherein heat is transferred from the dry supply air to an exhaust-air mixture, thereby conditioning the supply air for delivery and circulation to a plurality of cooling-coil units in a plurality of compartments. The exhaust air from the compartments is first mixed with some of the treated supply air to lower the absolute humidity to a value needed for effective regeneration of the desiccant wheel. An evaporative cooler then conditions the exhaust-air mixture for effective cooling of the supply air in the thermal rotor, which also serves as an air preheater for desiccant regeneration. The exhaust-air mixture is then heated to the desiccant regeneration temperature by passing the preheated exhaust air through a heat exchanger supplied with gas-turbine waste heat. After this heated exhaust-air mixture regenerates the desiccant wheel by fully drying out the desiccant on the wheel, it is expelled from the fan room.

11 Claims, 10 Drawing Sheets

| Summary of DDG-51 01 Level 5 Fan Room Locations Used For Dynamic Desiccant Technology Analysis | | | | |
|---|---|---|---|---|
| *Of the Fan Rooms on a DDG-51, the 5 which are applicable and have the most ship impact are* | | | | |
| **FAN ROOM Number** | **SYSTEM NO.** | **AIRFLOW TO RECIRC COILS** | **Fan Number** | **Remark** |
| 01-110-3-Q | SS01-120-1 | 2325 CFM | #81 | Contains comp't supply cooling coil and fan |
| 01-126-3-Q | SS01-137-1 | 6105 CFM | #82 | Contains comp't supply cooling coil and fan |
| 01-240-01-Q | SS01-252-2 | 4620 CFM | #83 | Contains comp't supply cooling coil and fan |
| 01-300-4-Q | SS01-301-2 | 4105 CFM | #84 | Contains comp't supply cooling coil and fan |
| 01-200-2-Q | SS01-201-2 | 1530 CFM | #85 | Contains comp't supply cooling coil and fan |

FIG. 4

AIR-FLOW STATES FOR THE FAN-ROOM AIR-PROCESSING SYSTEM SHOWN IN FIGURE 2

FAN-ROOM 01-110-3-Q (Chiller-Coil 81 load = 3.51 ton)

| STATION NO. | 1 | 2 | 3 | 4 | 5 | 6 | 7 | 8 | 9 | 10 |
|---|---|---|---|---|---|---|---|---|---|---|
| FLOW RATE (CFM) | 7483 | 1275 | 937 | 1275 | 6208 | 2325 | 2325 | 3104 | 1942 | 6208 |
| DRY BULB TEMP (°F) | 90 | 104.7 | 104.7 | 90 | 88 | 90 | 80 | 64.3 | 90 | x |
| WET BULB TEMP (o F) | 81 | 83.5 | 83.5 | 78 | 80.5 | 64.5 | 64 | 56.4 | 64.5 | x |

FAN-ROOM 01-126-3-Q (Chiller-Coil 82 load = 2.32 ton)

| STATION NO. | 1 | 2 | 3 | 4 | 5 | 6 | 7 | 8 | 9 | 10 |
|---|---|---|---|---|---|---|---|---|---|---|
| FLOW RATE (CFM) | 17375 | 1095 | 848 | 1095 | 16280 | 6105 | 6105 | 8140 | 5088 | 16280 |
| DRY BULB TEMP (o F) | 90 | 100.9 | 100.9 | 90 | 88 | 90 | 80 | 64.3 | 90 | x |
| WET BULB TEMP (o F) | 81 | 83.5 | 83.5 | 78 | 80.5 | 64.5 | 64 | 56.4 | 64.5 | x |

FAN-ROOM 01-240-01-Q (Chiller-Coil 83 load = 2.91 ton)

| STATION NO. | 1 | 2 | 3 | 4 | 5 | 6 | 7 | 8 | 9 | 10 |
|---|---|---|---|---|---|---|---|---|---|---|
| FLOW RATE (CFM) | 13715 | 1380 | 1055 | 1380 | 12335 | 4620 | 4620 | 6168 | 3858 | 12335 |
| DRY BULB TEMP (o F) | 90 | 100.6 | 100.6 | 90 | 88 | 90 | 80 | 64.3 | 90 | x |
| WET BULB TEMP (o F) | 81 | 83.3 | 83.3 | 78 | 80.5 | 64.5 | 64 | 56.4 | 64.5 | x |

FAN-ROOM 01-300-4-Q (Chiller-Coil 84 load = 7.91 ton)

| STATION NO. | 1 | 2 | 3 | 4 | 5 | 6 | 7 | 8 | 9 | 10 |
|---|---|---|---|---|---|---|---|---|---|---|
| FLOW RATE (CFM) | 14055 | 976 | 2119 | 3095 | 10960 | 4105 | 4105 | 5480 | 3428 | 10960 |
| DRY BULB TEMP (o F) | 90 | 88 | 88 | 90 | 88 | 90 | 80 | 64.3 | 90 | x |
| WET BULB TEMP (o F) | 81 | 80.5 | 80.5 | 78 | 80.5 | 64.5 | 64 | 56.4 | 64.5 | x |

FAN-ROOM 01-200-2-Q (Chiller-Coil 85 load = 4.40 ton)

| STATION NO. | 1 | 2 | 3 | 4 | 5 | 6 | 7 | 8 | 9 | 10 |
|---|---|---|---|---|---|---|---|---|---|---|
| FLOW RATE (CFM) | 6155 | 2070 | 1636 | 2070 | 4085 | 1530 | 1530 | 2043 | 1278 | 4085 |
| DRY BULB TEMP (o F) | 90 | 100.9 | 100.9 | 90 | 88 | 90 | 80 | 64.3 | 87 | x |
| WET BULB TEMP (o F) | 81 | 83.5 | 83.5 | 78 | 80.5 | 64.5 | 64 | 56.4 | 64 | x |

FIG. 5

DYNAMIC DESICCATION COOLING SYSTEM FOR SHIPS

STATEMENT OF GOVERNMENT INTEREST

The invention described herein may be manufactured and used by or for the Government of the United States of America for governmental purposes without payment of any royalties thereon or therefore.

BACKGROUND OF INVENTION

The commercial building business continues to place a strong focus on Active Humidity Control (AHC) equipment for commercial air conditioning (AC) applications. This has grown out of an understanding that for building applications, the independent control of humidity and temperature afforded by AHC offers marked advantages over the traditional "cool first" approach. AHC conserves energy while affording building occupants immediate and lasting improvements in comfort, health and indoor-air quality. However, such AHC is not presently used in ships, though ships could also benefit from such systems.

Current AC systems aboard ship use the traditional "cool first" approach, in which the air in the ship's compartments is simultaneously dehumidified and cooled to prescribed environmental conditions. The demand on the cooling system is especially acute in a hot and humid marine environment where moisture levels in the compartment replenishment air delivered to the AC system are higher than those encountered on land. AC systems, therefore, are designed/rated for the abnormally high heat loads needed to accommodate these environmental conditions. Because the resulting systems are very large and severely taxed in producing enough chilled water to lower both the absolute humidity (moisture content) and temperature of the compartment air to the prescribed conditions, they consume a tremendous amount of the generated electrical power on the ship.

Traditional vapor-compression AC systems are designed to remove both sensible heat and latent heat by cooling the outside air below the dew point to condense out water vapor. A large amount of electricity is required to provide the additional chilled water required for this large latent heat load. Dynamic-desiccant-based AC systems, on the other hand, use a desiccant to remove moisture from the outside air prior to cooling the air with traditional chilled water. Some type of heat source then regenerates the desiccant.

Desiccants are a class of materials that have a great affinity for capturing and retaining water and are used in many applications where the presence of water or water vapor would be detrimental. Desiccants fall into two broad categories: solids and liquids. Liquids are usually absorbents, which means they undergo a physical or chemical change when they collect moisture. Sodium chloride, commercial table salt, absorbs moisture from humid air and eventually becomes crystallized a chemical and physical change. In contrast, solid desiccants are usually adsorbents, which means they collect water vapor on their surface but do not undergo a chemical or physical change. The low-cost granules used in pet litter boxes are alumina silicate clay, which is also a dry desiccant material. Silica gel is a typical dry adsorbent desiccant in which the crystals appear to have a smooth sealed surface, yet a microscope reveals a massive internal network of passages and crevices. Desiccant materials such as these that adsorb moisture from humid air can collect between 20 and 40% of their dry weight in water vapor.

There are two processes in which desiccants are used: dynamic desiccation and static desiccation. Dynamic desiccation is a continuous and cyclic process in which a desiccant material that has adsorbed moisture from a supply-air stream is subjected to a hot-air stream which dries out, and thereby regenerates, the desiccant for reuse in supply-air desiccation. Static desiccation also removes moisture from air, but there is no regeneration process. The desiccants are simply removed and discarded when saturated with moisture.

Static desiccants are primarily used in packaging, storage, and preservation of medicines, electronic and mechanical equipment, and other materials that have adverse or undesirable reactions to the presence of moisture. Dynamic desiccants are used in various building dehumidification applications, refrigeration systems, air-handling equipment, compressed-gas generation (air, nitrogen), vessel lay-up, reduction gears, etc. The primary desiccants used for these applications are molecular sieve, activated alumina, and anhydrous calcium or hygroscopic salts; these materials can be formed into granular beds or rotary wheels.

The wheel form of the dynamic desiccant is commonly known as the desiccant wheel and is used extensively in the design of desiccant-based, air-conditioning systems. The desiccant wheel is typically a circular device that is composed of a plurality of thin sheets of plastic or metal that are coated with a desiccant. The wheel, which is situated in the ducts of the air-conditioning system, is perforated to allow for the passage of air. The duct system is split to provide two countercurrent flow passages, one of which furnishes the supply air being dehumidified and the other which furnishes the air needed to regenerate the desiccant. The wheel slowly rotates to facilitate the transfer of moisture from the saturated desiccant to the regeneration air.

While supply air treated by dynamic desiccation has a moisture content much lower than that achieved by conventional chiller coils, commercial applications of the desiccation process generally do not exhibit high energy savings since a heat source, such as fossil-fuel-fired water or air heater or an electric heater, is required for indirect or direct heating of the regeneration air.

SUMMARY OF INVENTION

The present invention describes a method and apparatus for controlling the temperature and absolute humidity of air supplied to compartment cooling coils on a gas-turbine-powered ship through a dynamic-desiccation system (DDS). The system passes supply air through a desiccant wheel, which dries and concomitantly heats the supply air. This supply air stream is then passed through a rotatable thermal wheel whereby heat is transferred from the dry supply air to an exhaust-air-stream to finally condition the supply air for delivery and circulation to a plurality of cooling coil units in a plurality of compartments. The exhaust air from the compartments, which is mixed with some of the conditioned supply air to achieve the absolute humidity needed for effective regeneration of the desiccant wheel, is passed through an indirect evaporative cooler to meet the predetermined heat load on the rotatable thermal wheel. After this exhaust-air-stream mixture has been preheated by the thermal wheel, it is then heated to the desiccant regeneration temperature by passing it through a second heat exchanger, wherein engine-exhaust waste heat is transferred to the exhaust air stream mixture or regeneration air. After this heated regeneration air regenerates the desiccant wheel by fully drying out the desiccant, it is then expelled from the fan room.

Optionally, the method could be implemented in a land based installation where a sufficient waste-heat source is collocated with an HVAC system for a building. AHC based on dynamic-desiccant technologies in accordance with the present invention could realize significant benefits in energy reduction and health and comfort for personnel in conditioned spaces.

For a better understanding of the present invention, together with other and further objects thereof, reference is made to the following description, taken in conjunction with the accompanying drawings, and its scope will be pointed out in the appended claims.

BRIEF DESCRIPTION OF DRAWINGS

FIG. 4 is a table summarizing fan room locations and air flows used in the Example.

FIG. 5 is a table summarizing the air-flow states at various numbered points for the fan room configuration of the DDS in FIG. 2.

DETAILED DESCRIPTION

Figure 1:
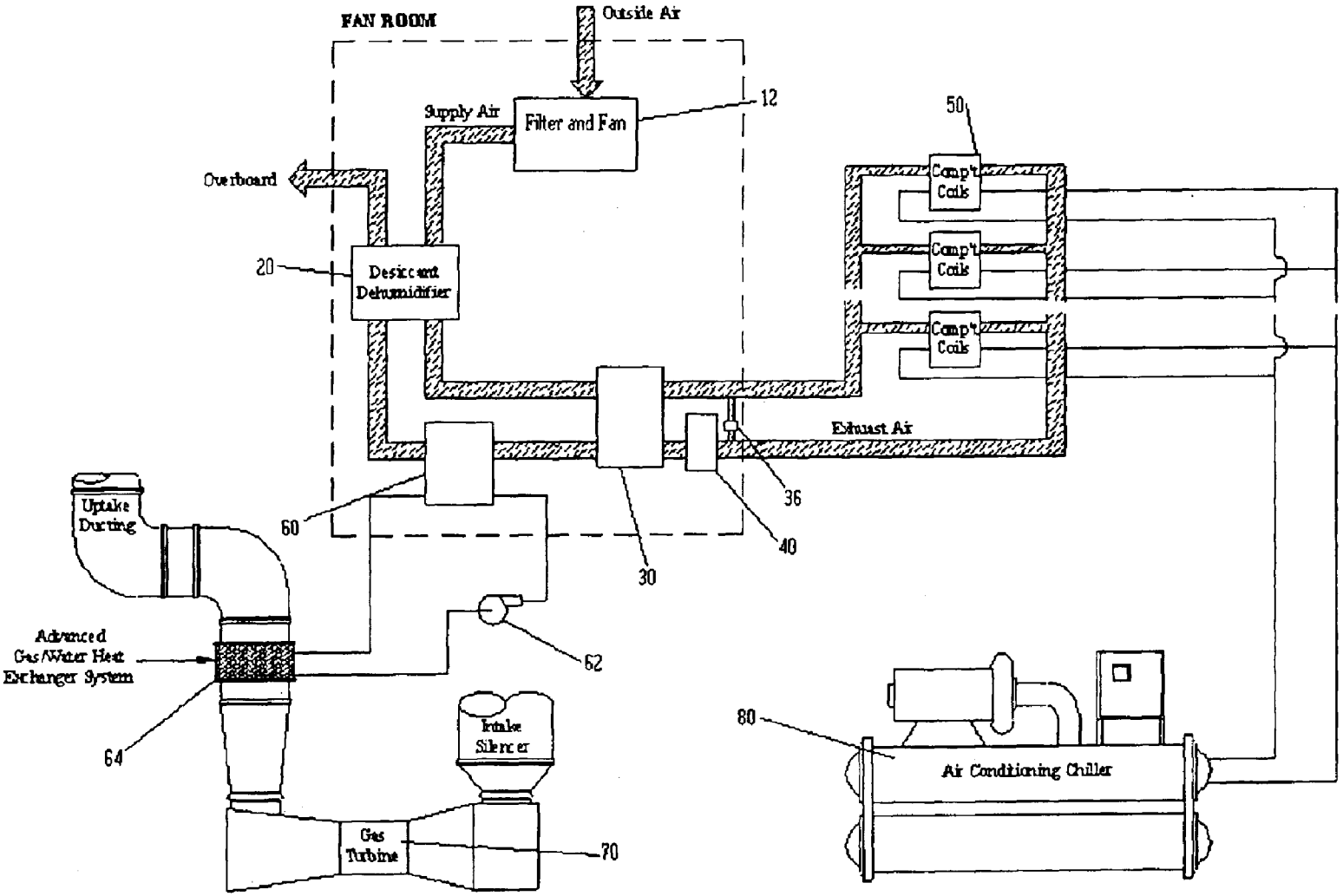
FIG. 1 illustrates one embodiment of the present invention in the HVAC system of a ship.

Referring to FIG. 1, a general schematic of the HVAC system on board a ship illustrates the method and apparatus for dehumidifying outside air prior to delivery to the compartment cooling coils 50, in accordance with the present invention. On the supply side, outside air is drawn through a series of filters and fans 12 and then passed through a desiccant wheel 20, which removes moisture from the outside air stream to lower the humidity of the outside air to a predetermined target value. This dry supply air is then cooled by a thermal rotor 30 and then sent to the various compartment cooling coils 50 (similar units are understood to have the same identifying numbers that are left out of the drawing for clarity). The compartment cooling coils 50 are fed chilled water from the AC plant chiller 80 to cool and dehumidify the supply air received from the fan room. The compartment cooling coils 50 are designed to deliver the supply air at the correct temperature and humidity needed to handle the heat load seen by any particular compartment. In a conventional HVAC system, a significant portion of the coil heat load is the latent heat load required to lower the moisture content of the incoming supply air. In the present invention this latent heat load has been largely removed from the supply air prior to the compartment cooling coils 50.

Figure 2:
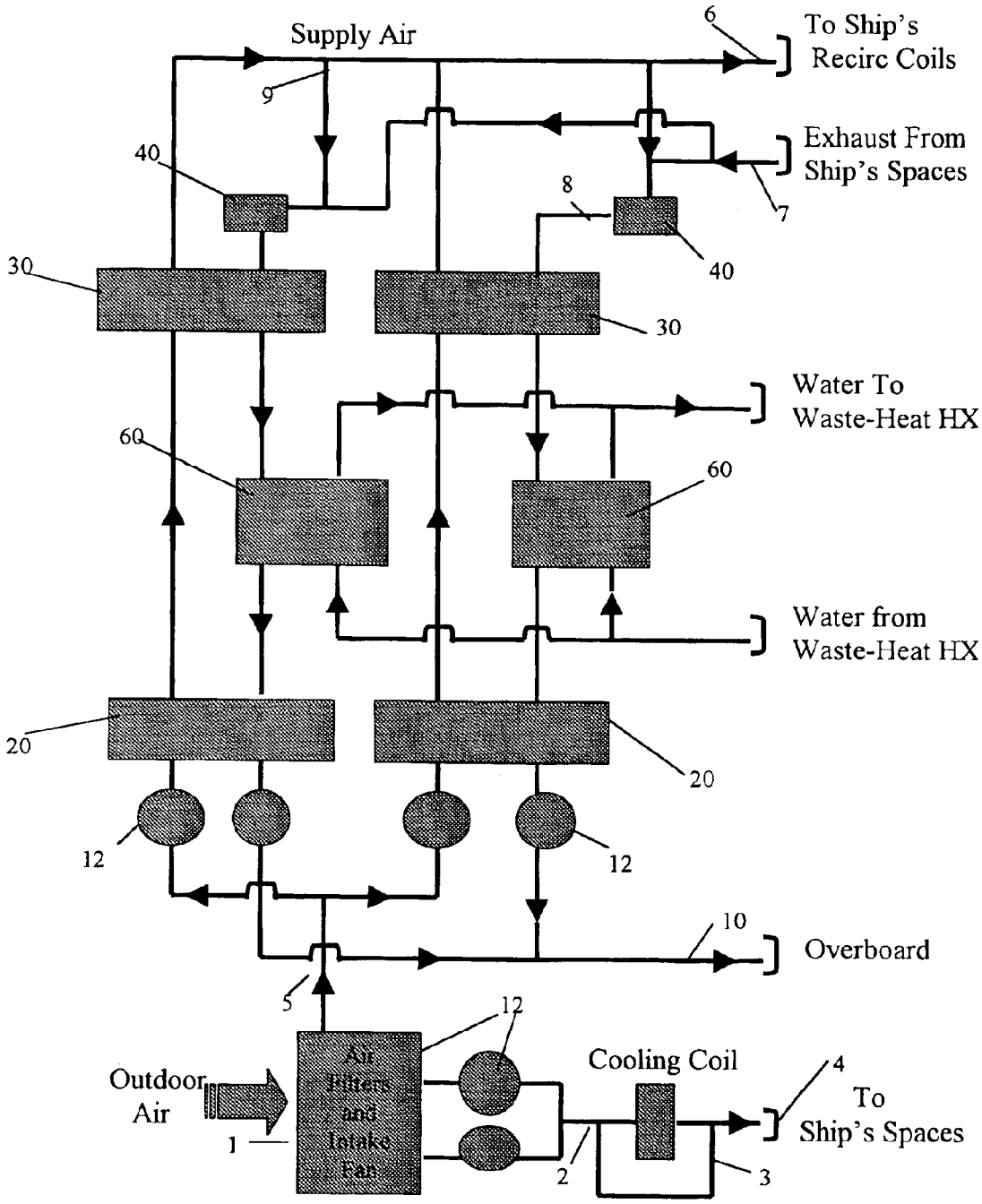
FIG. 2 is a flow diagram of a dual parallel-branch of an embodiment of the DDS in accordance with the present invention.
Figure 3:
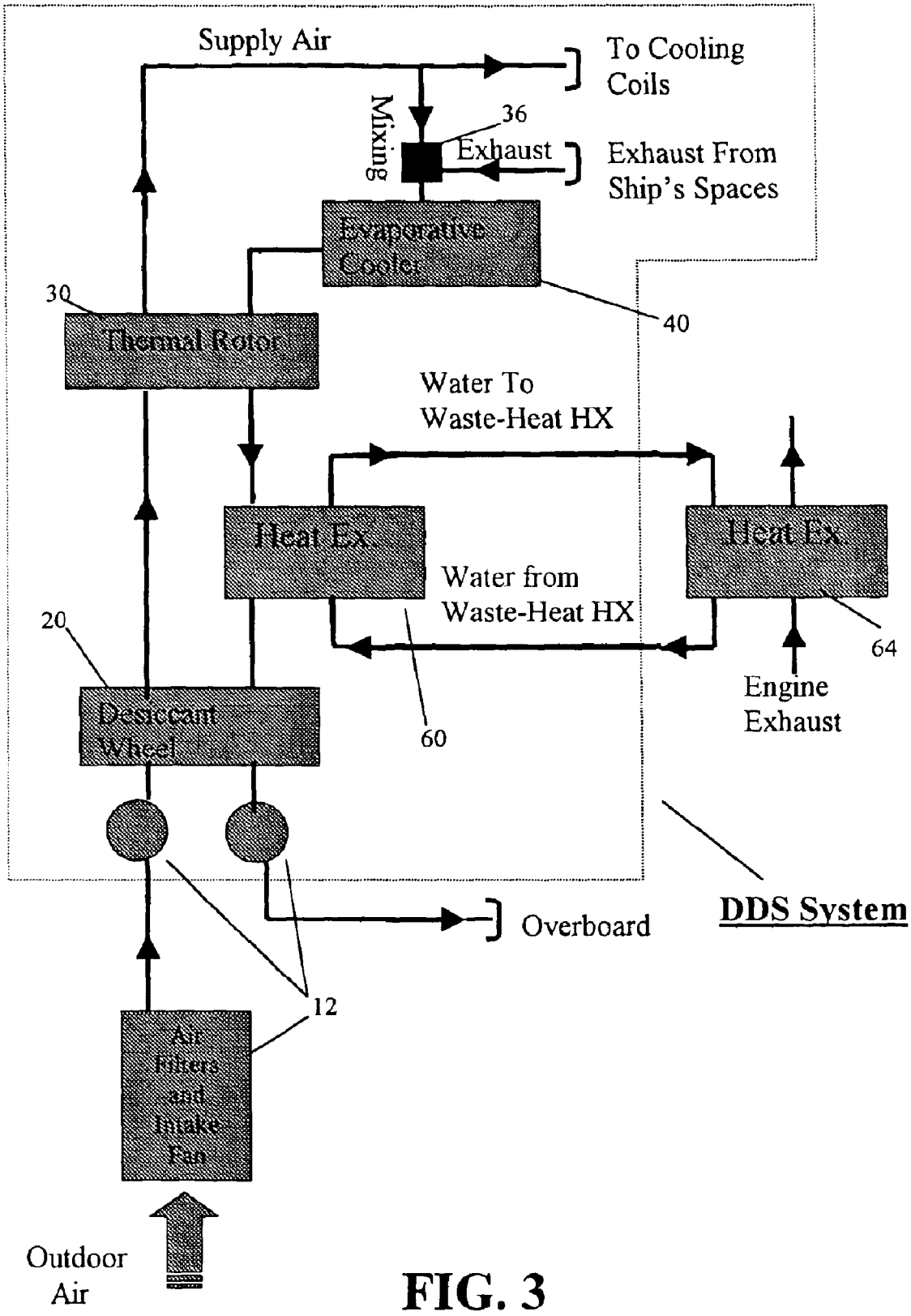
FIG. 3 is a flow diagram of one branch of the parallel flow circuit depicted in FIG. 2 in accordance with the present invention.

FIGS. 2 and 3 present a more detailed flow schematic of an embodiment of the present invention. The dual-branch system depicted in FIG. 2 is implemented to meet fan-room dimensional constraints and provide redundancy. Given a different size fan room, it would be within the teachings of the present invention to design and operate a DDS with only one such branch or with more than two.

FIG. 3 is a schematic of an embodiment of the DDS with only one flow branch circuit. On the exhaust side, the exhaust air returning from the conditioned compartments is first augmented by treated supply air in mixer 36, which yields a mixture with a lower humidity and slightly higher temperature. This mixture (regeneration air) is then cooled by passing it through an evaporative cooler 40. After the regeneration air has been preheated by supply air in thermal rotor 30, it is passed through waste-heat exchanger 60, which heats the regeneration air stream to the target regeneration temperature, the temperature that will fully regenerate the desiccant wheel 20. The regeneration or exhaust air stream is then expelled overboard by a fan 12. For ship compartments that are not part of the recirculation systems, a small conventional fan-room cooling system is needed. The components of this system are illustrated on the bottom of FIG. 2, to the right of the main intake filters and fans 12.

As shown in FIG. 3, the supply air enters the fan-room through a series of filters and fans 12 and is then dried to the target humidity by passing it through one half of desiccant wheel 20. The target humidity is achieved by a dehumidification process wherein the supply air passing through revolving desiccant wheel 20 saturates the desiccant material with the moisture adsorbed from the supply air. This saturation is a result of the high adsorption of water characteristically exhibited by desiccant materials. As the desiccant wheel 20 turns, it subjects the saturated desiccant to the regeneration air stream, which dehydrates the desiccant through a regeneration process that is continuously applied to the other half of the revolving desiccant wheel 20. The desiccant wheel 20 is constructed of thin sheets of perforated metal or plastic discs that are coated with desiccant material such as titanium silicate. Other types of desiccants that may be used are molecular sieves, silica gel, activated alumina or hygroscopic salts. The desiccant wheel 20 is divided by split-ducting to handle countercurrent flow of the supply and regeneration air streams, with one half dedicated to dehumidification and the other half dedicated to desiccant regeneration. The desiccant wheel 20 is rotated on its axis so that the desiccant undergoes the continuous cyclic process of supply air dehumidification and desiccant regeneration by the heated regeneration air.

The exothermic reaction between the desiccant and the moist supply air in desiccant wheel 20 effects significant heating of the supply air. This reaction necessitates the introduction of a means for cooling the supply air to a predetermined dry-bulb temperature. This cooling process consists of a revolving wheel or thermal rotor 30 that transfers heat from the supply-air stream to the regeneration-air stream, thus preheating the regeneration air before delivering it to heat exchanger 60. The thermal rotor 30, divided by a split-duct system similar to that in desiccant wheel 20, is preferably a metal wheel which has a plurality of perforations and spins slowly about a central axis to convey heat from the supply air to the exhaust air. After cooling by the thermal rotor 30, the supply-air stream is delivered to the compartment cooling coils 50.

Since the absolute humidity of the compartment exhaust air returned to the fan room is higher than that needed for desiccant regeneration, a portion of the dry supply air exiting thermal rotor 30 is mixed, via valves and control circuits (not shown), with the exhaust air at a point upstream of evaporative cooler 40. The process of mixing a large portion of treated supply air with the exhaust air reduces the absolute humidity of the regeneration-air mixture to the predetermined value needed to fully dehydrate desiccant wheel 20. However, since this regeneration air is too hot to cool the supply air leaving thermal rotor 30 to its predetermined temperature, it is first passed through evaporative cooler 40. By an indirect process, evaporative cooler 40 cools the regeneration air to its wet-bulb temperature without altering its absolute humidity. However, since the regeneration air leaving thermal rotor 30 is below the predetermined temperature needed for fully dehydrating the desiccant, it must be heated in heat exchanger 60. The heat transferred in exchanger 60 is supplied by heat exchanger 64, which transfers to a liquid stream, such as water, some of the waste heat in the exhaust gas of the engines 70 normally employed for ship-service (SS) power. Preferably, heat exchanger 64 would have a finned-tube design, wherein the liquid flows inside tubes equipped with external transverse fins across which the gas flows. The waste heat conveyed by this liquid stream is used to preheat the regeneration air in heat exchanger 60, at a point immediately upstream of desiccant wheel 20. This regeneration-air stream moves parallel to, but in a direction opposite, that of the supply-air stream. The heating process in heat exchanger 60 is essential in raising the temperature of the regeneration air to a predetermined value needed for complete dehydration of desiccant material in the regeneration side of desiccant wheel 20. As in a conventional fan room, the regeneration air is ejected overboard after leaving the regeneration side of desiccant wheel 20.

Figure 7:
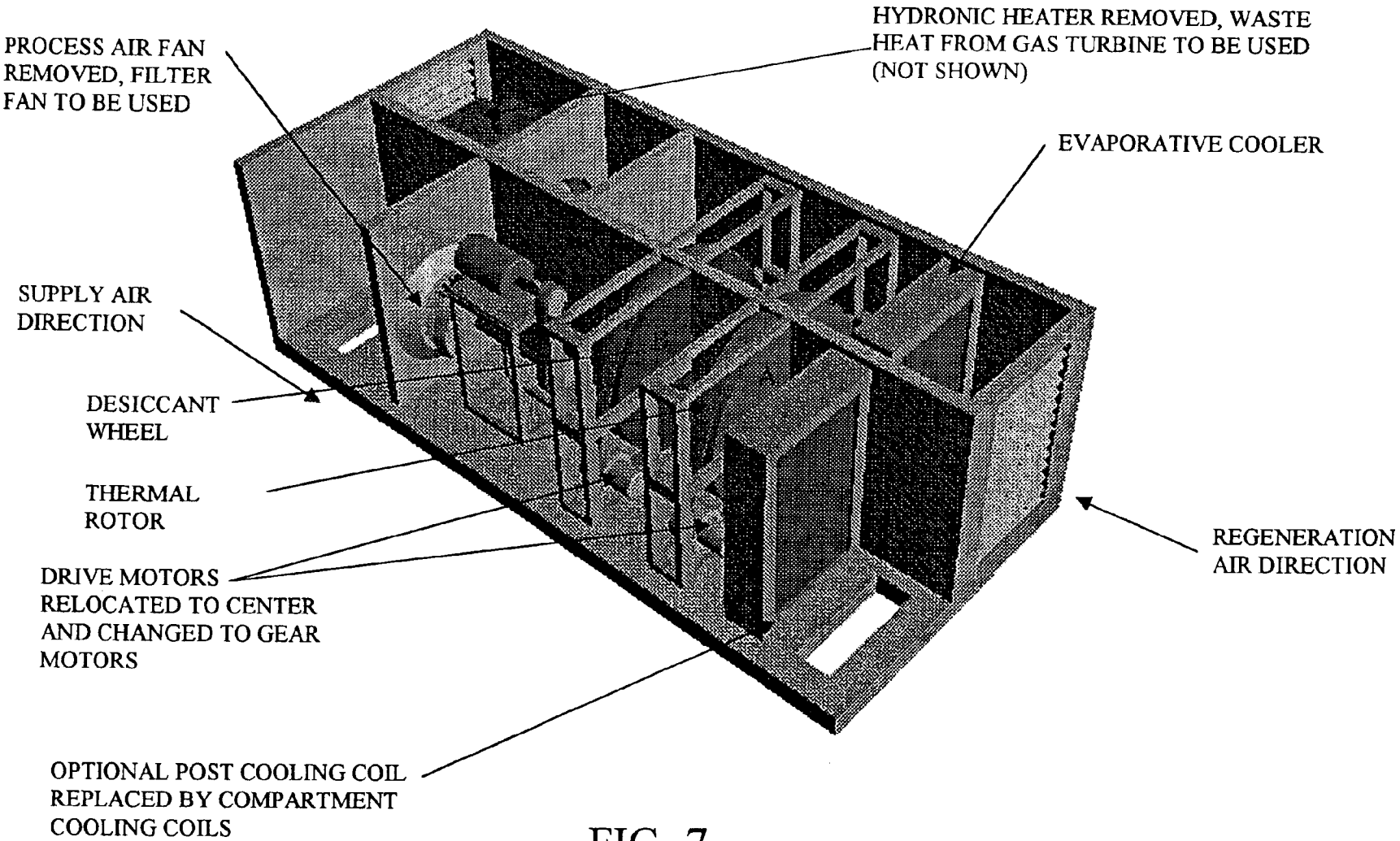
FIG. 7 illustrates some of the modifications necessary to existing fan-room equipment to practice the present invention.

FIG. 7 shows some of the modifications to commercial fan-room equipment in order to practice the present invention. It only serves to illustrate how the invention may be practiced through a new combination of conventional components. It would be within the teachings of the present invention to apply the invention to a land-based installation in a high-humidity environment that had a readily available waste-heat source. For example, the DDS described could be used in conjunction with a commercial entity that generated their own power on site and thus the waste heat from the generators would be available to provide the regeneration heat source necessary for the dramatic energy savings that the present invention can achieve.

EXAMPLE: In applying the above DDS to a shipboard system, the potential for energy savings is based on the utilization of waste heat for heating the regeneration air to the predetermined temperature needed for desiccant dry out. Therefore, gas turbine powered ships, which have an abundance of waste heat in the engine exhaust, are among the best candidates for utilizing this energy-saving invention. To characterize savings, the present invention has been applied to a DDG-51 class ship that contains five fan rooms that furnish replenishment air to the ship's compartment recirculation coils 50. FIG. 4 summarizes the location and flows for these five fan rooms. Outdoor air is first processed through these centrally located fan rooms before it is distributed to the ship's compartments. Under warm climatic conditions, chilled-water cooling coils located in fan rooms of this type utilize a certain portion of their intake air as replenishment air. Since fan-room cooling coils only serve to offset the sensible heating of the air by the intake fans, the replenishment air delivered to the compartments still contains a high moisture content (~125 gr/lb). This circumstance imposes a high latent heat load on the compartment recirculation cooling coils 50, which must maintain low humidity within the compartments. By incorporating into the centralized fan rooms a low-energy process for removing replenishment-air moisture, the AC system is potentially able to virtually eliminate the latent heat load seen by the compartment coils. In the case of a DDG-51 Class destroyer, the proposed fan-room processes described above impact both the existing air coolers in five fan rooms located on the ship's 01 level and at least 73 compartment chilled-water coils 50 that recirculate replenishment air received from these fan rooms. These cooling coils 50 constitute the recirculation systems supported by the ship's four AC plants.

The example characterizes a minimum-energy AC system that utilizes a DDS in accordance with the present invention to deliver replenishment air at the optimum dry-bulb and wet-bulb temperatures needed by the compartment coils 50. A psychometric analysis was conducted to determine the new AC system heat loads due to both the fan-room coils (due to the new airflow arrangements) and the compartment coils that will operate under the above inlet conditions. The analysis assumes that all airflow rates remain constant and that the required compartment air temperatures, relative humidity, and sensible-heat factors remain unchanged. Replication of any energy pickup processes associated with a particular compartment was also essential.

In view of the effort involved in analyzing all 73 compartment recirculation coils in the AC system, a method was devised whereby the system cooling load could be predicted by extrapolation, through a suitable scale factor, from the cooling load prediction for a judiciously selected subsystem of coils. It was concluded that the appropriate coil subsystem should be one served by a single fan room and should exhibit an average product of coil load and replenishment fraction close to that for the entire system. It was found that this simulation parameter could be satisfied by a 16-coil subsystem that included those coils having the largest values of the parameter.

The predetermined value for the moisture content of the replenishment air delivered to the compartment coils was found by examining the baseline coil exit conditions given in the subsystem coil performance data. These data showed that the optimum moisture content for minimizing the latent heat load on all subsystem coils was 50 gr/lb. To estimate the dimensions of the required DDS machinery, the fan room delivering the largest replenishment airflow was selected. On the basis of this airflow and a predicted DDS replenishment-air, dry-bulb temperature of 90° F., preliminary machinery sizes and airflow conditions were determined. These data were then utilized to assess overall AC system performance.

In order to meet fan-room dimensional constraints and provide redundancy, two parallel desiccant circuits were necessary, as shown in FIG. 2. The exothermic nature of the desiccant moisture adsorption process causes marked heating of the supply air. Since chiller coils are not used in these circuits, the supply (replenishment) air is cooled to the desired temperature by a rotary heat exchanger 30, whose cold side receives regeneration air that has been cooled by an indirect evaporative process. A rotary exchanger 30 employed in this manner also serves as a preheater for reducing the load on the regeneration-air heater 60. However, to enhance the desiccant-regeneration process, the absolute humidity of the regeneration air stream is reduced by combining a portion of the conditioned supply air with the air exhausted from the compartments. FIG. 5 predicts, for each of the five fan rooms, the airflow state at each of the circuit locations numbered 1 to 10 in FIG. 2. For completeness, FIG. 2 also shows a conventional chilled-water circuit (numbers 2–4) for servicing those spaces not equipped with recirculation-type cooling coils.

Table 1 presents an energy capitulation based on the above analysis and assumptions. It is seen that the total energy consumed by both the fan-room coils and the compartment recirculation (replenishment air) coils has dropped from 507 tons to 372 tons, the latter value obtained by applying the above scale factor (defined as the baseline total-system-to-subsystem energy ratio) to the load found for the 16-coil DDS subsystem.

TABLE 1

ENERGY CAPITULATION FOR A DYNAMIC DESICCANT BASED SHIPBOARD AC SYSTEM
Number of chilled water coils in the subsystem analyzed = 16
Total number of chilled water coils in the ship's re-circulation systems #= 73

$$\text{Calculated load scale factor for subsystem coils} = \frac{\text{Total coil load on re-circ system}}{\text{Total coil load on subsystem}} = \frac{0.982 \times \text{Total flow rate thru all re-circ system coils}}{\text{Total flow rate thru subsystem coils}} = 5.83$$

| | SUBSYSTEM | | TOTAL SYSTEM | |
|---|---|---|---|---|
| | BASELINE | DYNAMIC DESICCANT | BASELINE | DYNAMIC DESICCANT |
| Replenishment Fraction* | 20.1 | 20.1 | 15.5 | 15.5 |
| Overall Compartment SHF** | 0.706 | 0.938 | 0.788 | Xxxx |
| Energy Consumed (Tons) | 76 | 60.3 | 443.3 | 351.5 |
| Compartments | | | | |
| Fan Rooms | Xxxx | Xxxx | 63.93 | 21.05 |
| Total | Xxxx | Xxxx | 507.2 | 372.55 |
| ENERGY SAVING (TONS) | | | | 134.65 |

*Replenishment fraction = Overall fraction of compartment coil flow received from fan rooms (%)
**SHF = Sensible heat factor = Sensible heat/Total heat
#Re-circulation systems are those systems being replenished by fan room air As shown in Table 1, the scale factor is closely approximated by the ratio of the total coil throughput for the two systems. However, it must be noted that since the nearly 135-ton energy savings is based on a projection of a small number of cooling coils, it must be viewed as an approximation subject to verification by rigorous psychometric analysis of the entire 73-coil recirculation system. The approximate nature of the results is underlined by the observed differences in the baseline values of overall replenishment fraction and sensible-heat factor found for the two systems.

From a review of available data on chiller-plant coefficient of performance (CoP), it was determined that the values given for a seawater temperature of 75° F. were most appropriate for a ship operating in a 90° F. environment. The data also show that the CoP is a function of plant load; however, it was found that, over the range of 100–200 tons, the CoP varies by only 11%. Thus, little error is incurred in selecting a CoP of 0.75 at a load of 150 tons. By applying this value, the above DDS heat-load savings, Q, can be converted to savings in ship-service (SS) power, P, by the formula $$P = Q \times CoP = 101\ kW$$

The above power saving was expressed in terms of an annual savings in fuel by applying average-ship data that cites the portion of the annual operating time each SS engine spends at discrete values of specific fuel consumption (SFC) and load. From these data, the engine profile could be characterized by a mean SFC (denoted by $\underline{SFC}$), weighted with respect to both load and operating time, equal to 0.787 lb/hp-hr. On the basis of a total annual operating time (T) of 3000 hr, the annual fuel savings, E, is given by $$E = \underline{SFC} \times P \times T \times 1/0.746 = 319{,}653\ lb$$

To compute the total annual fuel consumed by the SS engines, the average-ship data were again applied in summing the products of the discrete values given for SFC, load $L_i$, and time-interval $\Delta t_i$, where i represents the $i^{th}$ time interval. Since U.S. Navy destroyers routinely operate with two SS engines on line, the annual fuel consumption (W) of the SS engines can be mathematically expressed as $$W_{SS} = 2 \times \Sigma(SFC_i \times L_i \times \Delta t_i) = 8{,}604{,}000\ lb.$$

By a procedure analogous to that for the SS engines, the annual fuel consumption of the propulsion engines can be similarly expressed as $$W_{prop} = 4 \times \Sigma(SFC_i \times L_i \times \Delta t_i) = 9{,}849{,}000\ lb.$$

From the above results, the fraction (f) of fuel saved annually (E) by the average ship is given by $$f = E/(W_{SS} + W_{prop}) = 319653/(8{,}604{,}000 + 9{,}849{,}000) = 0.0173 \text{ or } 1.73\%.$$

The accuracy of the above result is somewhat dependent on how closely the available engine data matches that for a ship whose entire annual deployment was in warm climates. Moreover, it also assumes that the annual operating times for a chiller plant and an SS engine are the same. Consequently, the above result should only be construed as an upper limit on the DDS payoff.

Figure 6:
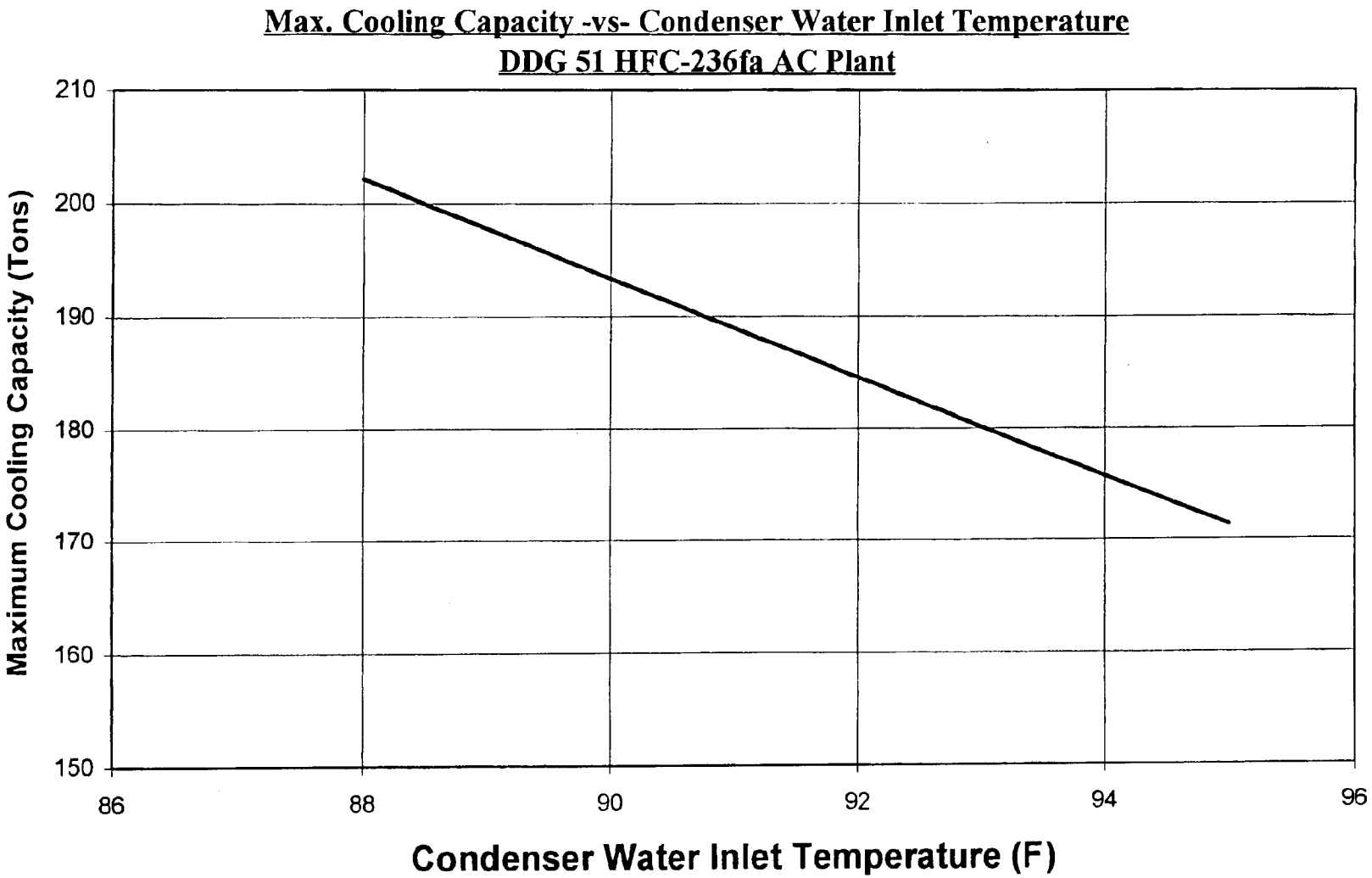
FIG. 6 is a graph of the chiller cooling capacity versus condenser water inlet temperature.
Figure 8:
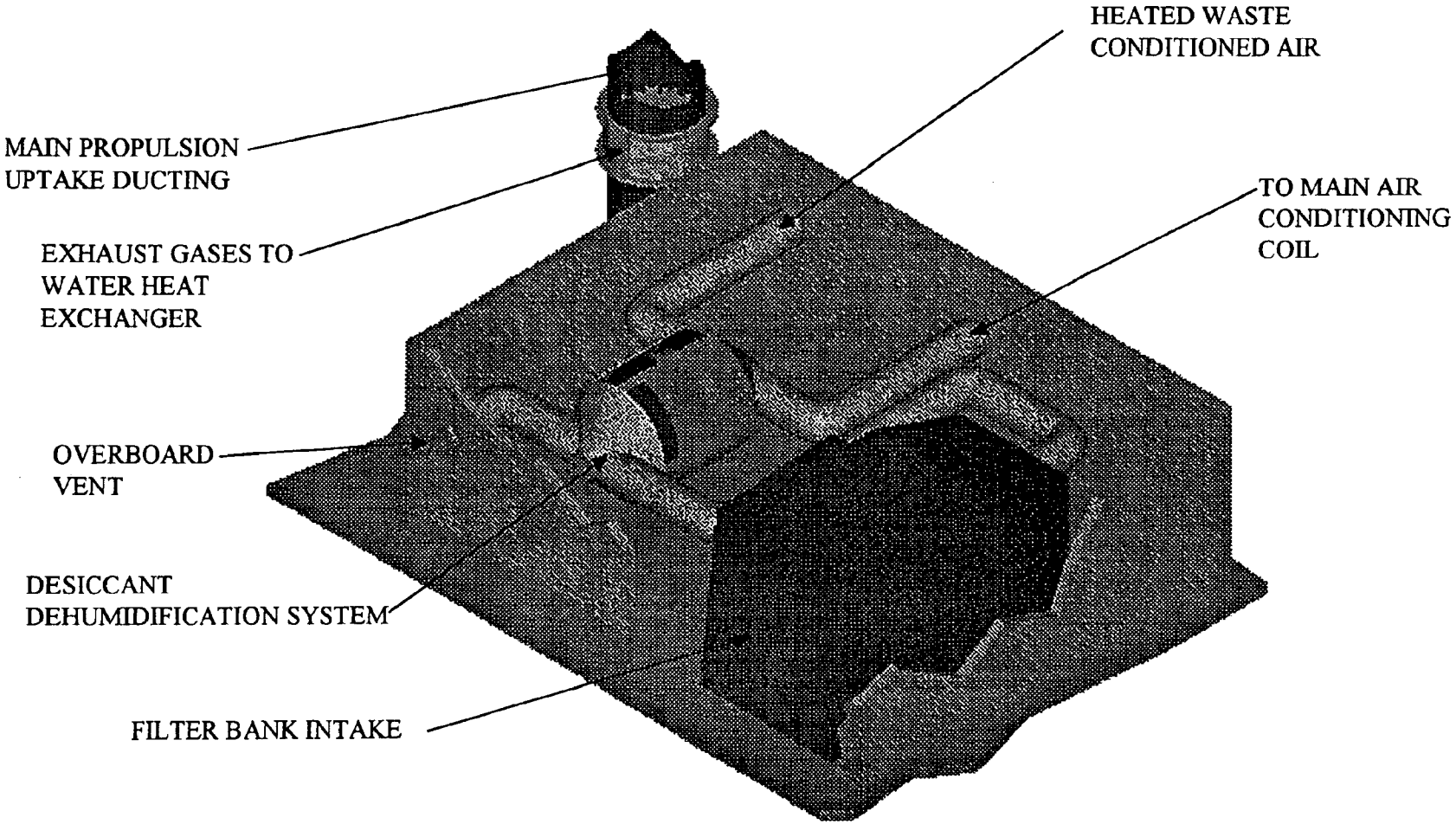
FIG. 8 is a graphical representation of an alternative embodiment of a dynamic-desiccant-based AC system that could be applied to a shipboard configuration in accordance with the present invention.
Figure 9:
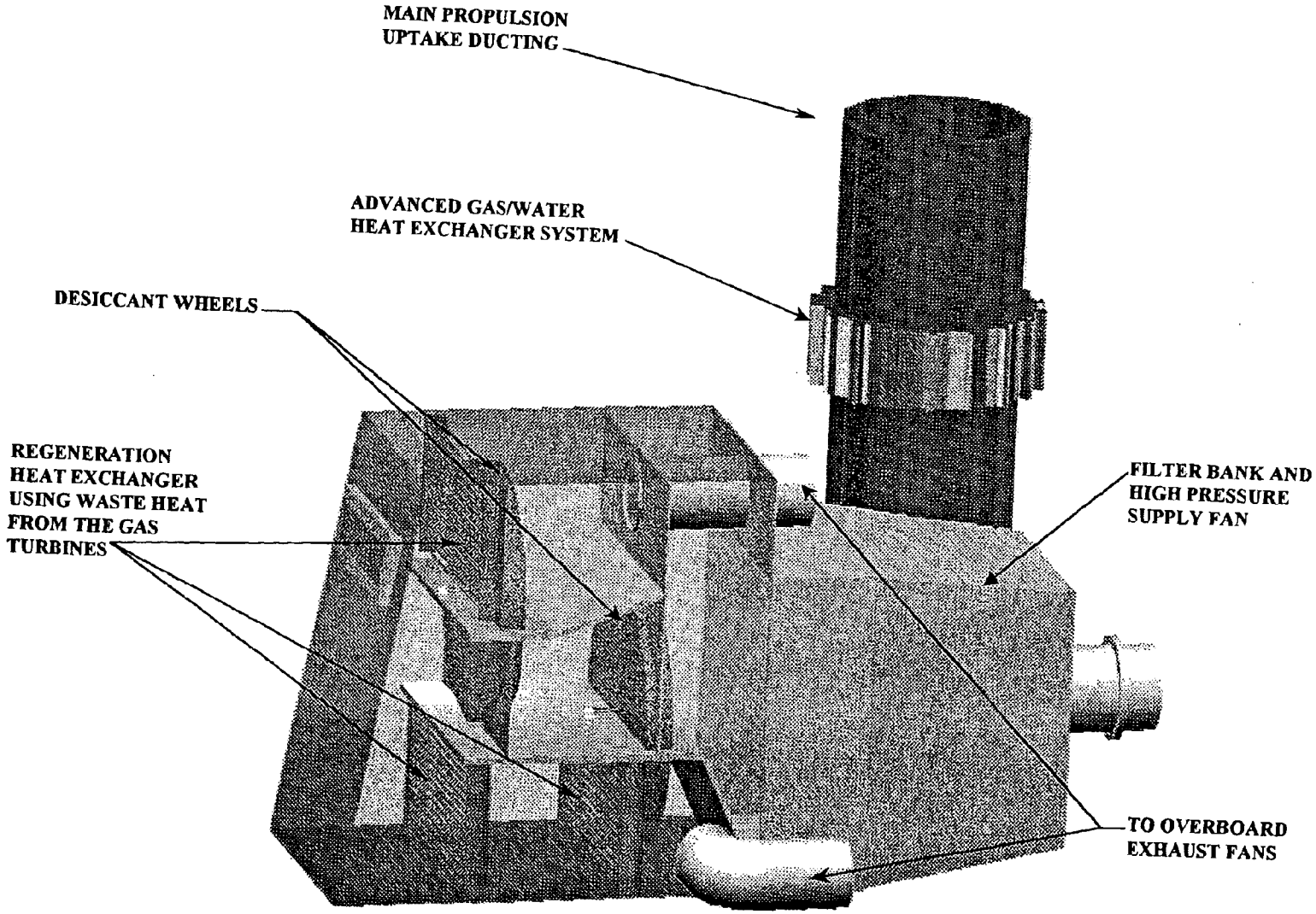
FIG. 9 is a graphical representation of an integrated alternative embodiment of a dynamic-desiccant-based AC system that could be applied to a shipboard configuration in accordance with the present invention.
Figure 10:
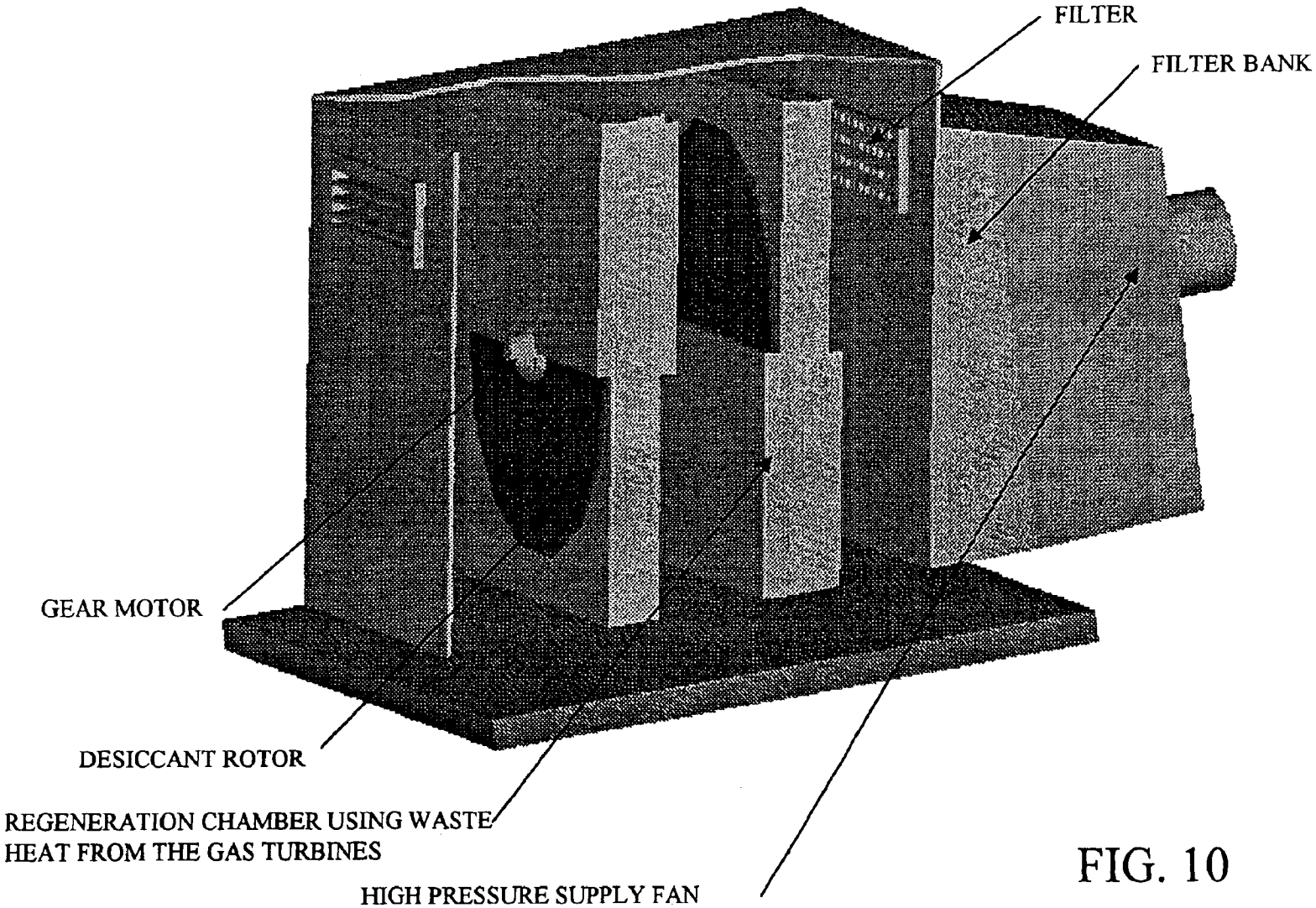
FIG. 10 is a graphical representation showing a second alternative embodiment of a dynamic-desiccant-based AC system that could be applied to a shipboard configuration in accordance with the present invention.

This energy study shows that a DDS has the potential to markedly improve the energy efficiency of the AC system aboard gas-turbine-powered ships. Such a system requires only a very small amount of energy for removing a substantial amount of water vapor from the outside "makeup" air entering the system. While the existing AC system would require a great deal of electrical energy to remove this water from the air, the application of a DDS avoids this energy penalty by greatly enhancing the performance and energy efficiency of the AC system. Also, due to the fact that the DDS in accordance with the present invention utilizes a regeneration process that does not require an additional primary heat source, energy cost savings are magnified. The DDS in accordance with the present invention may also greatly mitigate a current problem with U.S. Navy vessels operating in extremely warm waters. AC systems aboard Navy ships utilize seawater coolant in the refrigerant condenser. When the incoming seawater temperature is over 95° F., the cooling capacity of the AC system is markedly reduced, as shown in FIG. 6. The resulting elevation of the temperature and humidity of the processed air causes significant problems with electronic instrumentation and personnel comfort. With this DDS, makeup air supplied to the AC system is substantially lower in humidity, therefore allowing the system to provide cooler and dryer air through increased performance. FIGS. 8, 9, and 10 are graphical representations showing alternative dynamic-desiccant-based AC systems that could be applied to a shipboard configuration.

While there have been described what are believed to be the preferred embodiments of the present invention, those skilled in the art will recognize that other and further changes and modifications may be made thereto without departing from the spirit of the invention, and it is intended to claim all such changes and modifications that fall within the true scope of the invention.

What is claimed is:

1. A method for controlling the humidity of air supplied to cooling coils on a gas-turbine-powered ship through a dynamic desiccation system comprising:

providing a rotatable desiccant wheel divided into halves;

passing a supply air stream through one half of said desiccant wheel to remove moisture from said supply air stream;

regenerating said desiccant wheel by passing a heated exhaust air stream through the other half of said desiccant wheel;

providing a rotatable thermal rotor divided into halves;

passing said supply air stream through one half of said rotatable thermal rotor whereby heat is transferred from said supply air stream to said exhaust air stream thereby preheating said exhaust air stream;

circulating said supply air stream to a plurality of cooling coil units whereby said cooling units are supplied low humidity supply air;

providing a heat exchanger wherein waste heat form said gas-turbine engines is transferred to an exhaust air stream for generating said desiccant wheel;

passing said exhaust air stream through said heat exchanger wherein heat is transferred to said exhaust air stream after being preheated by said thermal rotor;

discharging said exhaust air stream overboard after passing through and thereby regenerating said desiccant wheel;

providing an evaporative cooler to cool the exhaust air stream before reheating said exhaust air stream be passing through said thermal rotor; and providing mixing means, wherein a portion of said supply air stream, prior to circulating to said plurality of cooling coil units, is mixed with said exhaust air stream prior to passing through said evaporative cooler.

2. A method for controlling the humidity of air supplied to cooling coils on a gas-turbine-powered ship through a dynamic desiccation system as in claim 1, wherein said method further comprises providing a filter to clean said supply air stream prior to passing through said desiccant wheel.

3. A method for controlling the humidity of air supplied to cooling coils through a dynamic desiccation system comprising:

providing a rotatable desiccant wheel divided into halves;

circulating a supply air stream through one half of said desiccant wheel to remove moisture from said supply air stream;

regenerating said desiccant wheel by circulating a heated exhaust air stream through the other half of said desiccant wheel;

providing a rotatable thermal rotor divided into halves;

circulating said supply air stream through one half of said rotatable thermal rotor whereby heat is transferred from said supply air stream to said exhaust air stream thereby reheating said exhaust air stream; circulating said supply air stream to a plurality of cooling coil units whereby said cooling units are supplied low humidity supply air;

providing a heat exchanger wherein waste heat is transferred to said exhaust air stream for regenerating said desiccant wheel;

passing said exhaust air stream through said heat exchanger wherein heat is transferred to said exhaust air stream after being reheated by said thermal rotor;

discharging said exhaust air stream overboard after passing through and thereby regenerating said desiccant wheel;

providing an evaporative cooler to cool said exhaust air stream before reheating said exhaust air stream by passing through said thermal rotor; and providing mixing means wherein a portion of said supply air stream, prior to circulating to said plurality of cooling-coil units, is mixed with said exhaust air stream prior to passing through said evaporative cooler.

4. A method for controlling the humidity of air supplied to cooling coils through a dynamic desiccation system as in claim 3, wherein said method further comprises providing a filter to clean said supply air stream prior to passing through said desiccant wheel.

5. A method for controlling the humidity of air supplied to cooling coils through a dynamic desiccation system comprising:

passing supply air through a desiccant wheel thereby drying and heating said supply air;

passing said dry supply air through a rotatable thermal wheel, thereby transferring heat from said dry supply air to an exhaust air stream;

mixing a portion of said dry supply air with said exhaust air stream;

circulating said dry supply air to a plurality of cooling coil units;

passing said exhaust air stream through an evaporative cooler to cool said exhaust air stream;

preheating said exhaust air by passing said exhaust air through said rotatable thermal wheel;

heating said preheated exhaust air to a desiccant regeneration temperature by passing said preheated exhaust air through a heat exchanger, wherein said heat exchanger heats said exhaust air by transferring heat from engine waste heat to said exhaust air;

regenerating said desiccant wheel by passing said heated exhaust air through said desiccant wheel;

discharging said exhaust air outdoors.

6. A method for providing supply air at a humidity level below that of ambient air to cooling-coil units on a gas-turbine-powered ship comprising:

providing means for circulating outside supply air, providing desiccant means for drying said supply air;

providing means for transferring heat from said dry supply air to an exhaust-air mixture;

passing said dry supply air through a plurality of cooling-coils units;

exhausting air from conditioned compartments;

circulating said exhaust-air mixture through an evaporative cooler;

heat exchange means for transferring waste heat from a gas-turbine-engine to said exhaust-air mixture;

drying said desiccant means wherein said desiccant means is regenerated; and means for expelling said exhaust-air mixture;

said exhaust-air is being mixed with a portion of said dry supply air before said exhaust-air mixture is circulated through said evaporative cooler.

7. An apparatus for providing supply air at a predetermined temperature and absolute humidity to a plurality of cooling-coil units on a gas-turbine powered ship, comprising:

an intake fan for drawing a supply air stream from outdoor air;

a filter;

a rotatable desiccant wheel partitioned to receive said supply air on one side and an exhaust-air mixture on the other side, wherein said supply side of said desiccant wheel adsorbs moisture from said supply air stream;

a thermal rotor partitioned to receive said supply air on one side and said exhaust-air mixture on the other side, wherein said supply air stream is cooled by transferring heat from said supply side to said exhaust side;

means for delivering said supply air stream to a plurality of said cooling-coil units;

means for exhausting air from areas that contain said cooling-coil units;

an evaporative cooler for indirect cooling of said exhaust-air mixture;

means for conveying said exhaust-air mixture through said exhaust side of said thermal rotor, wherein said exhaust-air mixture is reheated;

a heat exchanger, wherein a portion of the waste heat in said gas-turbine exhaust air mixture;

means for conveying said heated exhaust-air mixture through said exhaust side of said desiccant wheel, wherein said desiccant is regenerated;

means for expelling said exhaust-air mixture to the outdoors; and means for mixing said exhaust air from said compartments with a portion of said treated supply air prior to conveying said exhaust-air mixture to said evaporative cooler.

8. Apparatus for temperature and humidity treatment of incoming ambient air supplied to an installation within an air-stream, comprising: desiccant means for drying the incoming ambient air; coil means through which the ambient air dried by the desiccant means is conducted for cooling thereof into an outflow of exhaust air; and regeneration means operatively interconnected between the desiccant means and the coil means for targeted temperature control of a mixture of the exhaust air and the dried ambient air before discharge from the installation.

9. The apparatus as defined in claim 8, wherein the regeneration means includes: thermal cooling rotor means for circulation of both the dried ambient air before said cooling thereof within the coil means and said mixture of the exhaust air and the dried ambient air before said discharge thereof, and heat exchange means for regenerative heating of the air mixture emerging from the thermal cooling rotor means by a source of heat associated with the installation.

10. The apparatus as defined in claim 9, wherein the installation is a gas-turbine powered ship with engine exhaust gas as the associated heat source.

11. The apparatus as defined in claim 8, wherein the installation is a gas-turbine powered ship.

* * * * *